United States Patent [19]

Rollot

[11] Patent Number: 4,768,755

[45] Date of Patent: Sep. 6, 1988

[54] BLAST-FURNACES IN THE REGION OF THE POURING APERTURES

[75] Inventor: Pierre Rollot, Prouvy, France

[73] Assignee: Union Siderurgique du Nord et de l'Est de la France (USINOR), Puteaux, France

[21] Appl. No.: 758,644

[22] PCT Filed: Nov. 16, 1984

[86] PCT No.: PCT/FR84/00266

§ 371 Date: Aug. 23, 1985

§ 102(e) Date: Aug. 23, 1985

[87] PCT Pub. No.: WO85/02202

PCT Pub. Date: May 23, 1985

[30] Foreign Application Priority Data

Nov. 18, 1983 [FR] France ..... 83 18416

[51] Int. Cl.[4] ..... C21B 7/12

[52] U.S. Cl. ..... 266/195; 266/197; 266/271; 266/281

[58] Field of Search ..... 266/44, 45, 271, 191, 266/195, 196, 197, 236

[56] References Cited

U.S. PATENT DOCUMENTS 4,026,443 5/1977 Meier ..... 266/271
4,565,525 1/1986 Van Laar et al. ..... 266/197

FOREIGN PATENT DOCUMENTS 311966 8/1971 U.S.S.R. ..... 266/197

*Primary Examiner*—Melvyn J. Andrews
*Attorney, Agent, or Firm*—Cushman, Darby & Cushman

[57] ABSTRACT

The invention concerns a method for in particular repairing the region of the pouring apertures of a blast-furnace which mainly comprises employing a support element (10) independent of the casing (3) and on which bear the blocks (17) of refractory material. The support element (10) is first of all positioned relative to these blocks and then fixed in the final position relative to the casing (3), after which there is welded around the support element (10) and to the casing a sheet of metal which provides the seal between the support element and the casing.

14 Claims, 5 Drawing Sheets

BLAST-FURNACES IN THE REGION OF THE POURING APERTURES

The present invention relates to blast-furnaces, and more particularly to the arrangement of these blast-furnaces in the region of the pouring apertures or tap holes.

It is known that, in present blast-furnaces, the part of the casing surrounding the pouring aperture, commonly termed the "gendarme", acts as a support for an internal lining formed by blocks of carbon or other suitable refractory material, these blocks being arranged in a relatively complex arrangement so as to ensure the most effective seal it is possible to obtain of the pouring aperture. In order to achieve this seal, the "gendarme" comprises around the pouring aperture a flange which extends toward the interior of the blast-furnace and has an end surface which acts as a support for the carbon blocks. As mentioned before, in order to ensure that the carbon blocks have a good support and to avoid the piercing and rupture of the material constituting these blocks and also to be in a position to support the forces due to the ferrostatic pressure and to the pressure of the gases prevailing in the blast-furnace (this pressure being capable of reaching 40 to 50 Mpa), the blocks must bear against the casing with a very high precision, for example to within 5/10th of a millimetre.

In order to achieve this precision, the flange must be machined after the carbon blocks have been placed in position and presented to the flange. This "made to measure" machining of the flange in one piece with the "gendarme" constitutes an extremely long and delicate operation which renders the reconditioning of an existing blast-furnace very costly.

An object of the invention is therefore to provide a method and a device which permit the carrying out of this operation in a much more simple and rapid manner while providing excellent results as concerns the precision in the assembly of the carbon blocks and the seal obtained.

The invention therefore provides a method for manufacturing or repairing a blast-furnace, comprising a casing/defining pouring apertures, and blocks of refractory material bearing against a surface of the casing and closing said pouring aperture, said method comprising employing a support element independent of the casing, disposing said support element in such manner that it is capable of moving relative to the casing putting the blocks of refractory material in their correct position relative to the theoretical centre of the blast-furnace, which has for effect to bring the support element in its correct position relative to the blocks of refractory material, fixing the support element on the casing, withdrawing the blocks of refractory material, fixing on the casing and the support element a metal band providing the seal between these two elements, and then effecting a conventional operation for filling the gap between the casing and the refractory material.

According to other features:

the support element is first of all suspended from the casing;

before fixing the support element on the casing, the support element is positioned relative to the casing by means of screws which bear against the casing;

the fixing of the support element on the casing is achieved by blocks;

the temporary and/or final fixing of the support element relative to the casing is achieved by welding the support screws to the casing;

a groove is provided in the carbon blocks in which a part of the support element is engaged.

Another object of the invention is to provide an arrangement of a blast-furnace in the region of the pouring aperture comprising a casing defining an opening corresponding to the pouring aperture, and a lining of blocks of refractory material closing said opening in a sealed manner by cooperating with a support surface rigid with the casing, wherein the support surface is defined by a support element independent of the casing but fixed to the casing, a metal band fixed to said support element and to the casing providing the seal between these two elements.

According to other features:

the support element includes means for suspending it from the casing;

the support element carries adjustable means for placing it in a chosen position relative to the casing;

the support element is fixed to the casing by said adjustable means;

the support element is fixed to the casing by welded spacer blocks;

the support element is embedded in a groove formed in the blocks of refractory material.

The invention will be described in more detail hereinunder with reference to the accompanying drawing which is given merely by way of example and in which.

Figure 1:
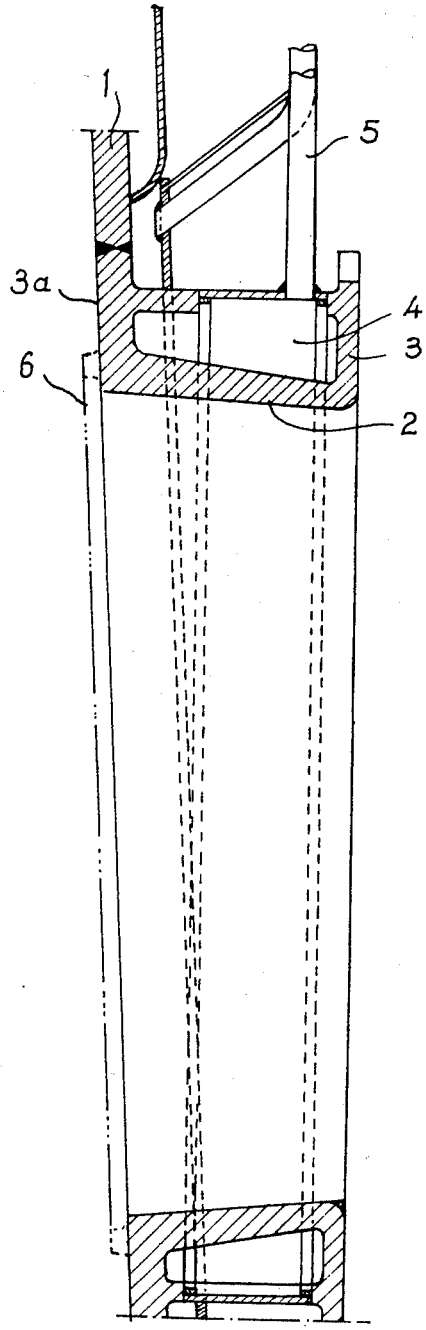
FIG. 1 is a vertical sectional view of the casing structure of a blast-furnace in the region of a pouring aperture or tap hole.

FIG. 1 shows a part 1 of a casing structure of a blast-furnace in the region of a pouring aperture or tap hole 2 of the latter. In this region, a part 3 of the casing structure, which is usually termed the "gendarme", defines the pouring aperture and, around this pouring aperture, a cooling chamber 4 connected to a suitable liquid circuit 5.

Shown in dot-dash line in FIG. 1 is a flange 6 which projects toward the interior of the blast-furnace and which represents the state of the art according to which this flange is moulded in one piece with the "gendarme" or part 3 of the casing structure and defines a support surface for blocks of refractory material (not shown), the machining of this surface being particularly long and delicate.

Figure 3:
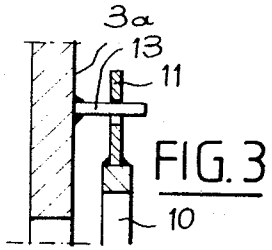
FIG. 3 is a sectional view taken on line 3—3 of FIG. 2.
Figure 4:
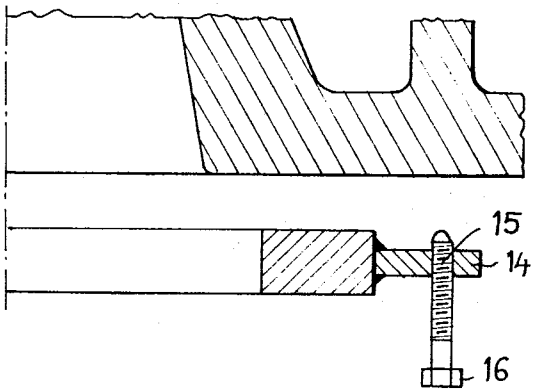
FIG. 4 is a sectional view taken on line 4—4 of the FIG. 2.
Figure 2:
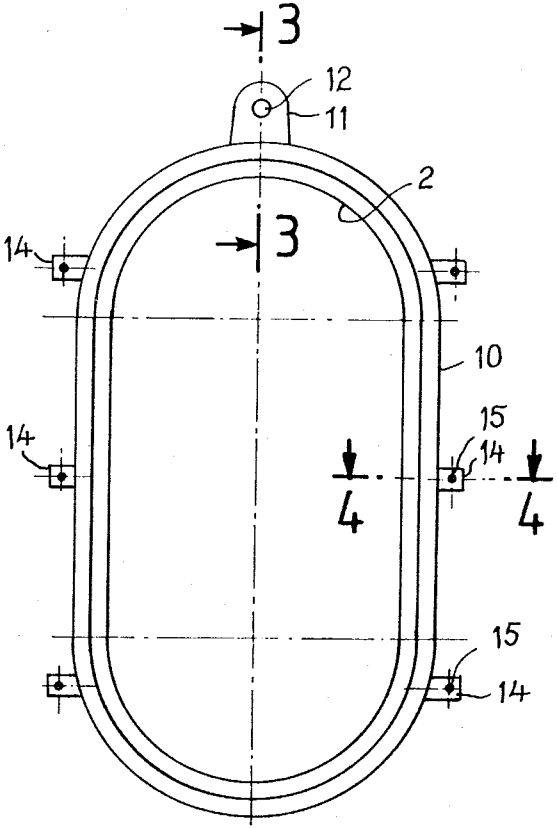
FIG. 2 is an elevational view from the interior of the blast-furnace illustrating a first stage of the method according to the invention.
Figure 5:
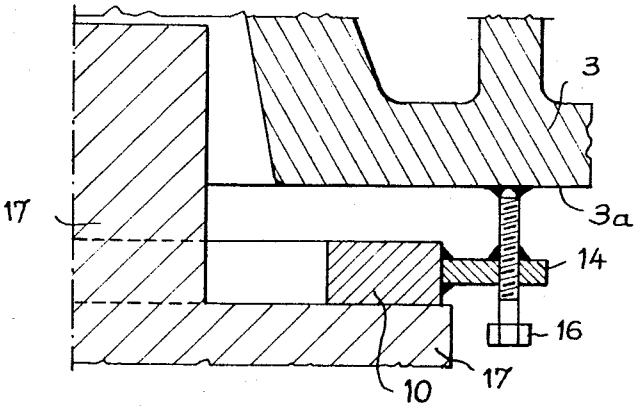
FIG. 5 is a view similar to FIG. 4 illustrating a following stage of the method.

The method and the device according to the invention will be described with reference to FIGS. 2 to 9. According to the invention, there is employed a support element 10 for the carbon blocks which is adapted to replace the flange in one piece with the part 3 of the casing structure shown in FIG. 1. This support element has a ring shape corresponding to that of the opening 2 and a dimension which is slightly larger than the latter, as can be seen in FIG. 2. This element has, in its upper part, a lug 11 provided with an aperture 12 and adapted to permit the hanging of this element 10 from a rod 13 welded to the inner surface 3*a* of the casing structure (FIG. 3). The element also carries a plurality of lugs 14 which extend outwardly and in which are formed tapped apertures 15 for receiving screws 16 (FIG. 4).

In a first stage, the support element 10 is hung from the casing structure of the blast-furnace and can therefore move relative to the latter. There are then placed in their correct position relative to the theoretical centre of the blast-furnace the blocks 17 of carbon or other suitable refractory material which bear against a support surface of the element 10 remote from the inner surface of the casing structure.

The latter then takes up its correct position and, in order to maintain it in this position, the screws 16 are shifted until they abut against the wall inner surface 3*a* of the casing structure. These screws are welded, on one hand, to the casing and, on the other hand, to the lugs 14 (FIG. 5) so as to temporarily fix the support element.

The carbon blocks are then withdrawn so as to finally fix the element 10 to the casing.

Figure 7:
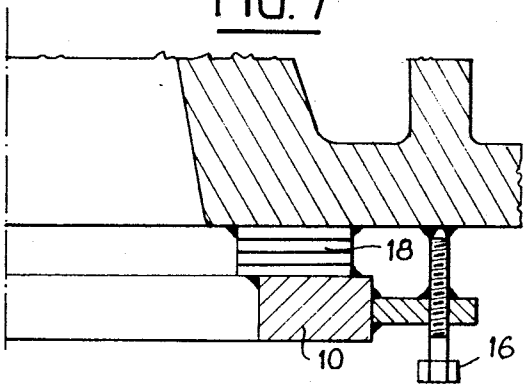
FIG. 7 is a sectional view taken on line 7—7 of FIG. 6.
Figure 6:
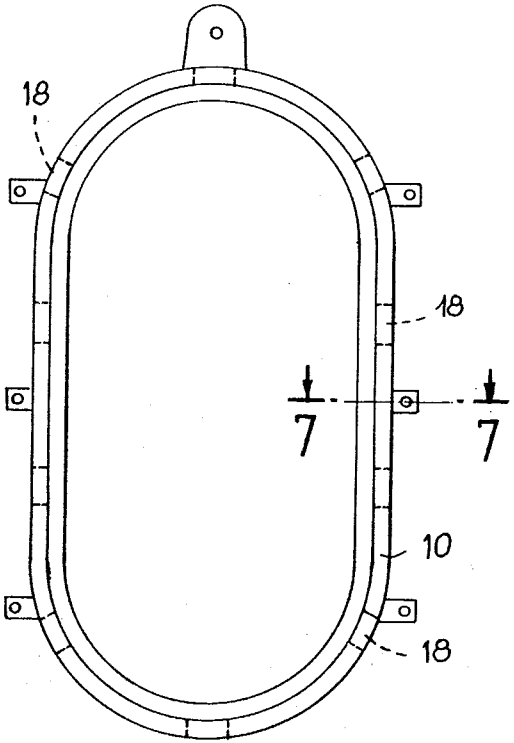
FIG. 6 is a view similar to FIG. 2 also illustrating a stage of the method according to the invention.

In the embodiment shown in FIGS. 6 to 9, this fixing is achieved by means of sets of spacer or packing blocks 18 disposed between the element 10 and the casing and welded to the element 10 and the "gendarme" 3 (FIG. 7).

Figure 9:
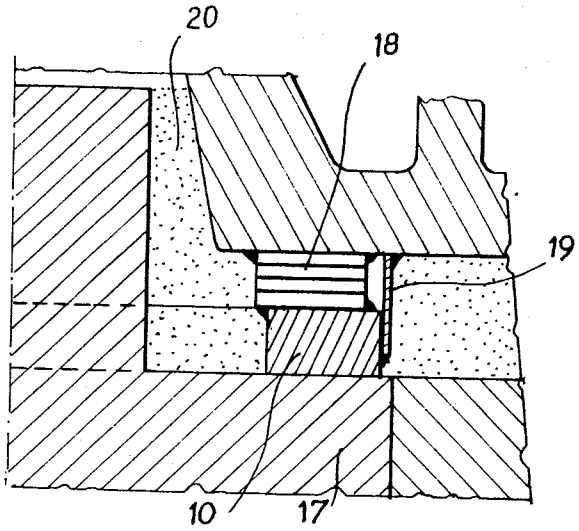
FIG. 9 is a sectional view taken on line 9—9 of FIG. 8.
Figure 8:
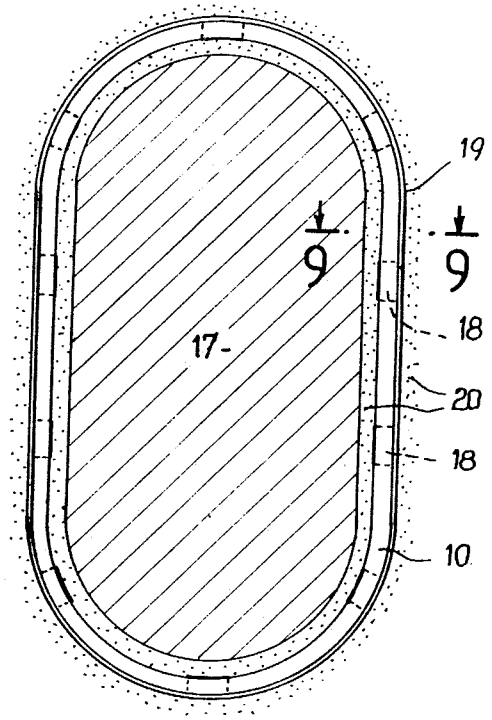
FIG. 8 is a view similar to FIGS. 2 to 6 illustrating a last stage of the method.

When this has been carried out, the lugs 11, 14 and the screw 16 are cut off, and there is welded to the periphery of the element 10 and to the casing structure 3 a band 19 of sheet metal for achieving the seal between these two elements 10 and 3 (FIGS. 8 and 9). The last operation comprises filling the gap between the blocks 17 of refractory material and the casing structure with a usual material 20 such as paddled clay.

Figure 10:
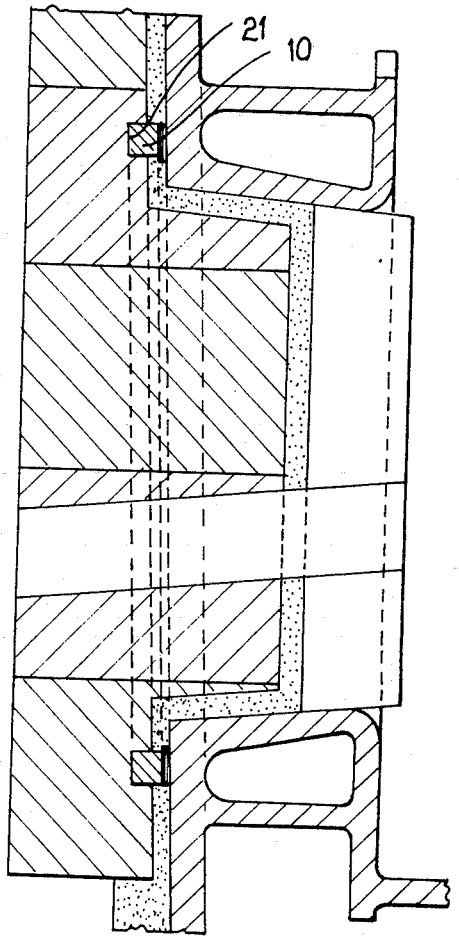
FIG. 10 is a sectional view of the region of the pouring aperture or tap hole of a blast-furnace illustrating a modification.
Figure 11:
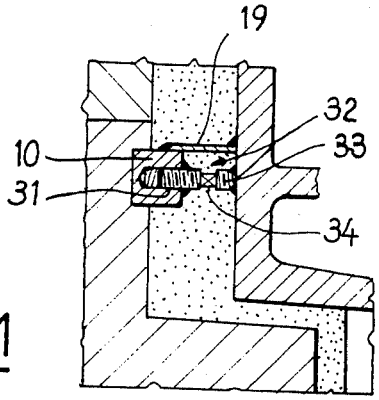
FIG. 11 is a detail view illustrating another modification.

In the modification shown in FIGS. 10 and 11, the carbon blocks 17 adapted to bear against the element 10 comprise a groove 21 in which this element is inserted.

Further, in the modification shown in FIG. 11, the method and the device are slightly simplified in that the use of spacer the blocks 18 as spacer means is avoided. Tapped apertures 31 are directly formed in the support element 10 on the side thereof facing the casing and adjustable spacer or packing means in the form of screws 32 are engaged in these apertures. In the course of the operation for positioning and fixing the support element relative to the casing structure, it is these screws which are welded to the adjacent wall inner surface of the casing and to the support element. Then, after withdrawal of the carbon blocks, the band of metal sheet 19 is directly welded to the support element 10 and to the casing structure. The heads of the screws 32 are shaped at 33 in such manner as to permit their welding to the casing structure while allowing the subsequent fixing of the sealing sheet 19. Further, a square portion or the like for the engagement of a tightening tool is provided in an intermediate region of the screw 32.

The method and the device according to the invention afford considerable advantages over the prior art:

an excellent seal is achieved since the precision of the bearing between the carbon blocks and the support element 10 is very good;

there is a considerable saving of time for a complete repairing operation; this time may be, for example, 1/10th of that of prior methods;

this method is consequently very economical and the means employed are simple and cheap;

in the modification shown in FIG. 11, this method is still further accelerated since the spacer blocks are eliminated;

in the embodiment shown in FIG. 10, the precision of the assembly between the carbon blocks and the support element is improved by the presence of the groove provided in the carbon blocks, and the seal, and consequently the safety, is thereby also substantially improved.

I claim:

1. A blast furnace comprising, in combination:

a metal housing having an inner surface and having an opening defined therethrough, a liner disposed within said metal housing adjacent to said inner surface thereof, a ring-shaped metal support element coupled to said inner surface in surrounding relation to said opening so as to have a first side thereof in facing relation to and spaced from said inner surface of said housing and a second side which is opposed to said first side and defines a ring-shaped support surface, spacer means mounted between said first side of said support element and said inner surface of said housing for maintaining the spaced relation thereof, a metal band mounted to said inner surface and mounted to and completely around said support element, means for sealing coupling said band to said support element and to said inner surface of said housing, first blocks of refractory material disposed in said opening in abutting and supporting relation to said ring-shaped support surface of said support element, and second blocks of refractory material disposed adjacent to said inner surface of said housing so as to define said liner, said spacer means maintaining the spaced relation of said support element and said inner surface of said housing so that said first blocks of refractory material are disposed in a desired position relative to said second blocks of refractory material and to said housing.

2. A blast furnace according to claim 1, wherein said means for sealingly coupling said band to said support element and to said inner surface of said housing comprises a weld therebetween.

3. A blast-furnace according to claim 1, wherein the space between said support element and said inner surface can be adjusted before said band is fixed to said support element and to said inner surface of said housing.

4. A blast-furnace according to claim 1, wherein said spacer means comprise a stack of packing blocks having an overall stack length adjustable by means of the number and thickness of said blocks.

5. A blast-furnace according to claim 4, further comprising a weld which fixes said packing blocks to said support element and to said inner surface of said housing.

6. A blast-furnace according to claim 1, wherein said spacer means comprise screw threaded members screwthreadedly engaged with said support element and abutting against said inner surface of said housing and adjustable by selectively screwing and unscrewing before said band is fixed to said support element and to said inner surface of said housing.

7. A blast-furnace according to claim 6, wherein said screw threaded members are welded to said support element and to said inner surface of said housing.

8. A blast-furnace according to claim 1, further comprising a groove in said first blocks of refractory material for receiving said support element.

9. A blast-furnace comprising:

a housing having an inner surface and having an opening defined therethrough, first blocks of refractory material disposed in said opening and second blocks of refractory material disposed adjacent to said inner surface of said housing and defining a lining of said housing, means for supporting and positioning said first blocks of refractory material relative to said second blocks of refractory material and said housing including a ring-shaped support element coupled to said inner surface in surrounding relation to said opening so as have a first side thereof in facing relation to and spaced from said inner surface of said housing and a second side which is opposed to said first side and defines a ring-shaped support surface for supporting said first blocks, a plurality of screw threaded spacer members disposed between said support element and said inner surface, said spacer members being screwthreadedly mounted to said support element and bearing against said inner surface of said housing, said support element being adjustable in position relative to said inner surface of said housing by selectively screwing and unscrewing said screw threaded members whereby a desired disposition of said first blocks relative to said second blocks and said housing can be obtained.

10. A blast furnace according to claim 9, further comprising means for initially loosely hanging said support element from said inner surface of said housing and initially allowing adjustment of said support element selectively toward and away from said housing.

11. A blast-furnace according to claim 10, wherein said means for hanging comprise a pin fixed to and substantially perpendicular to said inner surface of said housing and means defining an aperture in an upper part of said support element, said pin being slidably engaged in said aperture to allow adjustment of the position of said support element relative to said inner surface of said housing in a direction substantially perpendicular to said inner surface.

12. A blast-furnace according to claim 9, further comprising stacks of packing blocks interposed between said support element and said inner surface of said housing.

13. A blast-furnace according to claim 9, further comprising a weld which fixes said screw threaded members to said support element and to said inner surface of said housing so as to provide a predetermined position of said support surface and consequently a desired position of said first blocks relative to said housing and said second blocks.

14. A blast-furnace according to claim 9, wherein said support element comprises lugs spaced apart from one another around said support element and extending laterally therefrom, in which lugs said screwthreaded members are screwthreadedly engaged.

* * * * *